US006239823B1

(12) United States Patent
Fotland

(10) Patent No.: US 6,239,823 B1
(45) Date of Patent: May 29, 2001

(54) ELECTROSTATIC LATENT IMAGE FORMING PRINTHEAD HAVING SEPARATE DISCHARGE AND MODULATION ELECTRODES

(76) Inventor: Richard Allen Fotland, 220 Chamberlain St., Holliston, MA (US) 01746

( * ) Notice: Subject to any disclaimer, the term of this patent is extended or adjusted under 35 U.S.C. 154(b) by 0 days.

(21) Appl. No.: 09/096,041

(22) Filed: Jun. 11, 1998

(51) Int. Cl.[7] ..... B41J 2/385; G03G 15/05

(52) U.S. Cl. ..... 347/127; 315/111.81; 347/128; 438/20

(58) Field of Search ..... 347/123, 127, 347/128; 29/825, 890.1; 315/111.81; 438/20

(56) References Cited

U.S. PATENT DOCUMENTS

| | | | | |
|---|---|---|---|---|
| 4,155,093 | | 5/1979 | Fotland . | |
| 4,160,257 | | 7/1979 | Carrish . | |
| 4,381,327 | | 4/1983 | Briere . | |
| 4,408,214 | | 10/1983 | Fotland . | |
| 4,628,227 | | 12/1986 | Briere . | |
| 4,679,060 | | 7/1987 | McCullum . | |
| 4,745,421 | * | 5/1988 | McCallum et al. | 347/127 |
| 4,958,172 | | 9/1990 | McCullum . | |
| 5,014,076 | * | 5/1991 | Caley, Jr. et al. | 347/127 X |
| 5,030,975 | * | 7/1991 | McCallum et al. | 347/148 |
| 5,315,324 | | 5/1994 | Kubelik . | |
| 6,061,074 | * | 5/2000 | Bartha et al. | 347/123 |

* cited by examiner

*Primary Examiner*—Joan Pendegrass

(57) ABSTRACT

Improved electrostatic latent image charge generator consisting of generator electrodes substantially in contact with one side of a first solid dielectric member; a discharge electrode substantially in contact with the other side of the solid dielectric member opposite the generator electrodes; a second solid dielectric member having one side substantially in contact with the discharge electrode; and modulator electrodes substantially in contact with the other side of the second dielectric member. The second dielectric member, generator electrodes, and modulator electrodes have a plurality of apertures in alignment with each other and with generator electrodes so that charge formed in discharge apertures may be extracted and employed to form an electrostatic latent image upon a dielectric image receptor. This architecture provides means for a greatly simplified the manufacturing method by providing two prefabricating flexible printed circuit assemblies which are laminated with an oxidation resistant dielectric sandwiched between the circuit assemblies.

15 Claims, 3 Drawing Sheets

ELECTROSTATIC LATENT IMAGE FORMING PRINTHEAD HAVING SEPARATE DISCHARGE AND MODULATION ELECTRODES

BACKGROUND OF THE INVENTION

The present invention relates to the generation of charged particles in air, and more particularly to the generation of charged particle images for electrographic imaging.

Charged particles for use in electrographic imaging can be generated in a wide variety of ways. Common techniques include the use of air-gap breakdown, corona discharges and spark discharges. Other techniques employ triboelectricity, radiation, and microwave breakdown. When utilized for the formation of latent electrostatic images, all of the above techniques suffer certain limitations in charged particle output currents and charge image integrity.

A further approach, which offers significant advantages in this regard, is described in Fotland, U.S. Pat. No. 4,155,093 (May 19, 1979) and the improvement disclosed in Carrish, U.S. Pat. No. 4,160,257 (Jul. 3, 1979). These patents disclose method and apparatus for generating charged particles in air involving what the inventors' term "silent electric discharge". The prior art general view of FIG. 1 shows a charge image generator 8 capable of forming an electrostatic latent image on electrostatic latent image receptor 25. Charge image generator 8 is supplied with a high voltage alternating potential from generator 10. This potential is applied between two electrodes, a generator electrode 12 and a control electrode 14. Electrode 14 contains a plurality of circular or slotted apertures opposing generator electrode 12. Solid dielectric member 16 is sandwiched between these electrodes. Generator electrode 12 is shown encapsulated by dielectric member 18. As disclosed in U.S. Pat. No. 4,155,093, the alternating potential causes the formation of a pool or plasma of positive and negative charged particles in the air region adjacent dielectric 16 and defined by the apertures in discharge electrodes 14. These charged particles may be extracted to form a latent electrostatic charge image.

The alternating potential supplied by generator 10 creates a fringing field between electrode 12 and electrode 14. When the electrical stress exceeds the dielectric strength of air, a discharge occurs in the fringing field air gap. Charge built up on the surface of dielectric 16 reduces the electric field in the air gap thus quenching the discharge. Such silent electric discharges produce a faint blue glow. In order that no discharge occur in the region between adjacent control electrodes in space 15, this region must be filled with a solid dielectric.

U.S. Pat. No. 4,160,257 teaches the use of isolation or screen electrode, 20, separated from control electrode 14 by spacer layer 22. Electrode 20 serves to screen the extraction electric fields in the region bounded by electrodes 14 and 20 from the external fields associated with the latent charge image formed on the surface of dielectric receptor 26. In addition, aperture 24 in electrode 20 provides an electrostatic lensing action. Passage of charged particles through isolation aperture 24 to the surface of image receptor dielectric 26 is controlled by electrical potentials applied control electrodes 14. The electrical potential of isolation electrode 20 is kept constant with time. The receptor dielectric is contiguous with conducting substrate 28. The edge of a second control electrode 17 is also shown in FIG. 1. The space electrically isolating control electrodes must be filled with a solid dielectric 15 to prevent air gap breakdown in this region.

The use of negative charges (electrons and negative ions) is preferred since higher negative output currents are obtained than when potentials are reversed to extract positive charges. Biasing power supply 34 provides a constant high-voltage accelerating field between dielectric receptor substrate 28 and isolation electrode 20. Negative charges are extracted from the discharge when print selector switch 36 is in position Y. In this case, a charge extraction field, provided by power supply 30, is present between electrodes 14 and 20. When switch 36 is in position X, a retarding field is applied by supply 32 and the retarding field prevents charge from escaping aperture 24.

The requirement that a high frequency voltage and an extraction voltage be simultaneously present to generate charge output provides the means for coincident selection thus enabling the multiplexing of charge output. The prior art view of FIG. 3 illustrates how the charged particle generator 57 may be multiplexed. An array of control electrodes 58-1 through 58-6 contains apertures 62 at crossover regions opposing generator electrodes 60-1 through 60-4. Dielectric layer 64 isolates generator and control electrodes. Isolation electrode 66 is contiguous with dielectric layer 64. Generator electrodes are sequentially excited by a high frequency high voltage burst of several cycles. Any location in the matrix may be printed by timing a data, or control, pulse to the selected control electrode simultaneous with excitation of the appropriate generator line.

Two methods of fabricating charge image generators are described in the patent literature. One method involves first forming a laminate consisting of discharge dielectric 16 sandwiched between metal foils which are subsequently chemically etched to form generator electrodes 12 and control electrodes 14. After etching, the generator electrode side of the laminate is bonded to dielectric 18 which, in turn, is bonded to a metal heat sink not shown in FIG. 1. The photo-etched laminate is then laminated, on the control electrode side, with a photo-etchable dry film soldermask or dry film photoresist. Next, openings are formed in spacer layer 22 to expose the apertures previously etched into the control electrodes. Finally, a previously etched isolation, or screen, electrode 20 is bonded to the spacer layer. Briere U.S. Pat. Nos. 4,381,327 and 4,628,227 and Fotland et al, U.S. Pat. No. 4,408,214, incorporated herein by reference, describes this method in detail.

A second fabrication method involves building up the layers starting with generator electrode 12 that is formed on insulating support 18. Layers are subsequently fabricated sequentially on this generator electrode structure. This technique is described in detail in the following U.S. Pat. Nos.: McCallum et al. 4,679,060; 4,745,421; 4,958,172; 5,030,975 and Kubelik 5,315,324 which are also incorporated herein by reference.

Both fabrication approaches employ spacer layers 22 between about 50 microns and about 150 microns in thickness. Since bathtub shaped apertures must be formed in the spacer layer, this layer is formed of either a dry film photomask or a dry film photoimagable solder mask material. Two layers are required for thicker spacing. Alternately, this spacer layer may be formed using screen printing of the appropriate thickness curable resin.

The space between adjacent control electrodes must be filled with solid dielectric 15 in order to prevent air-gap breakdown in the fringing fields adjacent the edges of the control electrodes. Air gap breakdown in this region increases the power required to drive the charge image generator and eventually results in arcing and catastrophic failure as the insulation is eroded in the highly oxidizing environment created by the discharge. U.S. Pat. Nos. 4,679,060 and 4,745,421 show a method of reducing the magnitude of the control electrode edge sealing problem by including the extra step of coating the control electrodes and spaces between these electrodes with a 25 micron layer of liquid solder mask. The cured solder mask effectively seals space 15. A thicker solder mask film is then laminated to the cured solder mask and the finishing steps carried out.

When a separate and distinct sealing operation is not employed, the dry film solder mask must be laminated to the control electrode and surrounding dielectric using a vacuum laminator arranged to provide sufficient heat and pressure so that the semi-molten dry film solder mask will flow into the spaces between the control electrodes thus effectively sealing this region.

A second manufacturing problem encountered in the present fabrication schemes involves alignment of control electrode apertures with corresponding screen apertures. Alignment between the control electrode apertures and corresponding generator electrodes is relatively easy since alignment is only required in one direction because the generator electrodes are in the form of stripes. In addition, the stripe width is typically chosen to be somewhat greater than the control electrode aperture diameter. The screen and control electrode apertures, however, must be accurately aligned in two directions over the entire width of the charge image generator in order to provide uniform charge output.

Additional problems relate to yield reductions associated with the flimsy nature of various layers. In the first above described fabrication method, a rather delicate thin mica strip is laminated with two metallic foils and these foils are then photo-etched to form the control and generator electrode shapes. Exposure to liquid photo-etching processing sprays very frequently leads to mica cracking. These cracks, in turn, lead to early life catastrophic charge image generator failure. In the second fabrication method described above, the control electrodes are etched as free-standing foil supported at the edges with pressure sensitive tape. The use of tape to minimize distortion of the freestanding foils is the subject of U.S. Pat. No. 4,745,421.

Accordingly, it is a principal object of the invention to simplify the manufacturing process of charge image generators. A further object is to provide a manufacturing method having improved manufacturing yields. Related objectives involve improve operating characteristics by reducing catastrophic failures and improving charge output uniformity. A still further objective provides for charge image generator cost reduction, Also, the invention provides for improved heat transfer from active discharge areas.

SUMMARY OF THE INVENTION

In fulfilling the above and additional objectives, the invention provides an improved charge image generator and process for manufacturing the improved image generator. The improved charge image generator consists of generator electrodes substantially in contact with one side of a first solid dielectric member; a discharge electrode substantially in contact with the other side of the solid dielectric member opposite the generator electrodes; a second solid dielectric member having one side substantially in contact with the discharge electrode and modulator electrodes substantially in contact with the other side of the second dielectric member. The second dielectric member, generator electrodes, and modulator electrodes have a plurality of apertures in alignment with each other and with generator electrodes so that charge formed in discharge apertures may be extracted and employed to form an electrostatic latent image upon a dielectric image receptor.

In this invention, the electrical discharge takes place adjacent the edges of a single electrode maintained at a constant electrical potential. The modulation of charge output is carried out using a plurality of remote electrodes. This contrast with prior are configurations where the discharge and modulation electrodes are one and the same.

The generator electrode, second dielectric member, and modulator electrodes may be formed as a flexible circuit assembly. Metal foils bonded to the flexible dielectric are photo-etched in registration. Photo-etched apertures formed in the discharge electrode or in the modulator electrodes may serve as a mask to define apertures or through-holes that are to be etched in the second dielectric member. A second flexible circuit may be etched to form the generator electrodes. The first solid dielectric is then sandwiched between these two flexible circuits. The resulting assembly is then bonded to a solid metal mounting substrate.

Use of this construction and fabrication procedure greatly reduces errors of misalignment, minimizes possible damage to the very thin first solid dielectric member, and eliminates the possibility of extraneous discharges in undesired regions adjacent the discharge electrode.

BRIEF DESCRIPTION OF THE DRAWINGS

The above and additional aspects of the invention are illustrated on the following brief description of the preferred embodiment, which should be taken together with the drawings in which.

DETAILED DESCRIPTION

Figure 1:
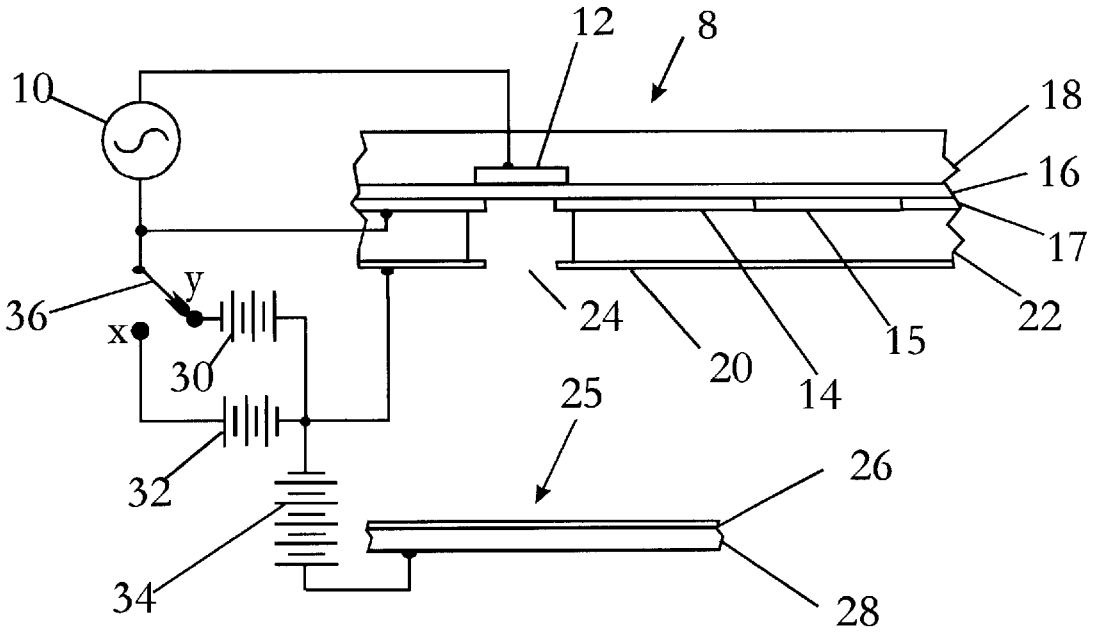
FIG. 1 (PRIOR ART)
FIG. 1 is a sectional schematic view of a prior art charge image generator in accordance with U.S. Pat. No. 4,160,257.
Figure 2:
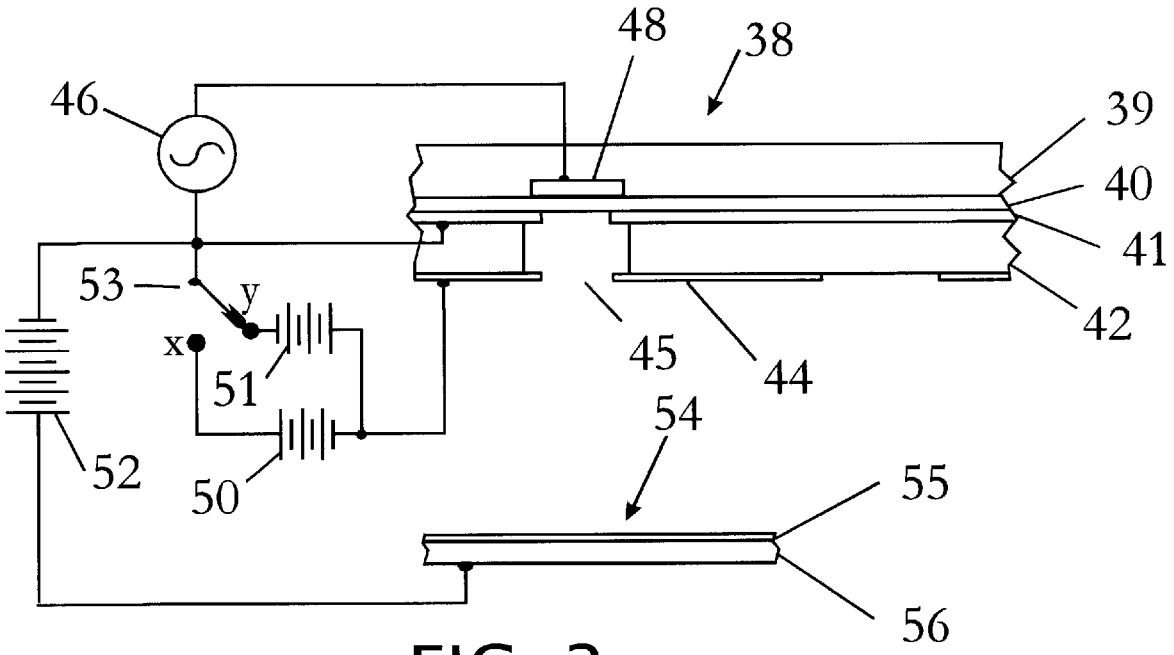
FIG. 2 is a sectional schematic view of a charge image generator in accordance with the present invention.

Reference should now be had to FIG. 2 that illustrates a charge image generator according to the invention. As seen in this sectional schematic view, charge image generator 38 includes a solid dielectric layer 40 carrying on one side a generator electrode 48 and on the opposite side a discharge electrode 41. The generator electrode 48 is encapsulated by solid dielectric 39 to prevent electrical discharges in the fringing field of this electrode. Modulator electrodes 44 are spaced from discharge electrode 41 by dielectric 42. Although only one generator and modulator electrode is shown in FIG. 2, a plurality of generator and modulator electrodes are employed in forming a multiplexed matrix of discharge elements according to the scheme shown in FIG. 4. Discharge electrode 41 is a single continuous electrode common to all discharge sites. The continuous nature of this electrode greatly improves heat transfer in contrast to prior art designs wherein the active discharge electrode is segmented into numerous finger electrodes. Apertures 45 are etched in the modulator electrode as well as in spacer layer 42 and discharge electrode 41.

Figure 3:
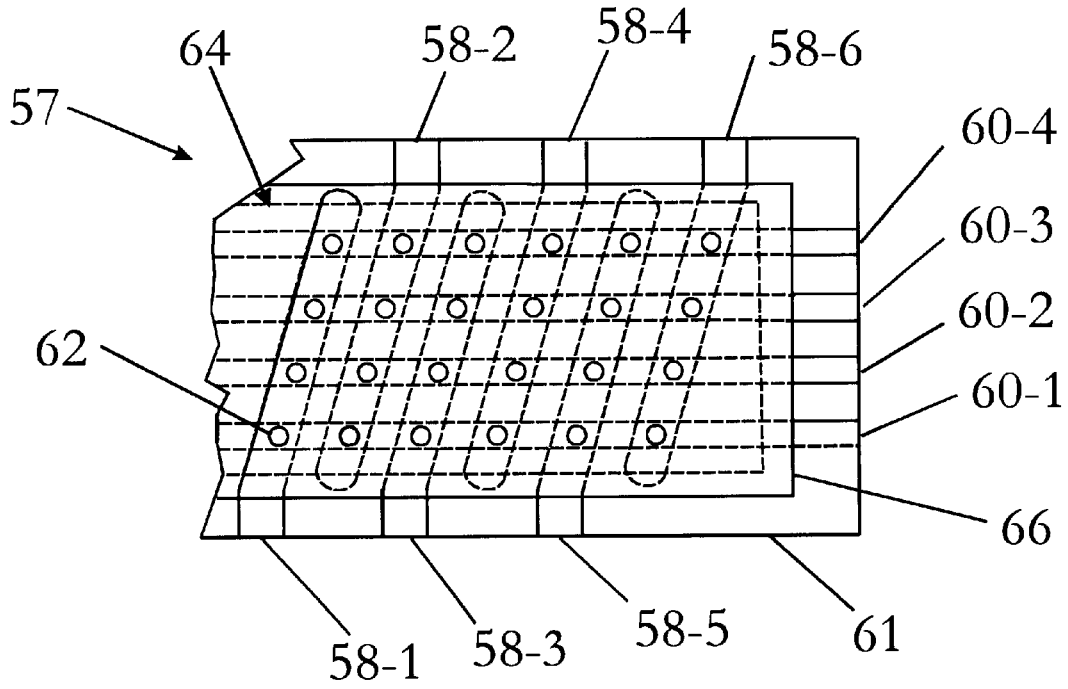
FIG. 3 (PRIOR ART)
FIG. 3 is view showing the layout of electrodes in accordance with U.S. Pat. No. 4,160,257.

A time varying high voltage supplied by high frequency generator 46 is applied between generator electrode 48 and discharge electrode 41. This high voltage is sufficient to cause air gap breakdown in the electrical fringing fields adjacent the apertures in discharge electrode 41. A modulating voltage is applied between discharge electrode 41 and modulator electrode 44 represented in FIG. 3 by supplies 50 and 51 and switch 53. When switch 53 is in position Y, the electric field between the generator and modulator electrodes is such that negative electrical charges are directed from the discharge electrode towards the modulator electrode. Conversely, when switch 53 is in position X, positive electrical charges are directed from the discharge electrode towards the modulator electrode.

A latent electrostatic image is formed on charge receptor 54 that consists of a dielectric layer 55 contiguous with conducting layer 56. Conducting layer 56 is electrically biased negatively with respect to discharge electrode 41 by means of high voltage supply 52.

When switch 53 is in position Y, the biasing field established by supply 51 causes negative charge to be extracted from aperture 45 and deposited upon dielectric 55 to form the latent electrostatic image. In position X, the biasing field supplied by supply 50 opposes the field set up by supply 52, and no charge is extracted. It has been observed that the available negative output current is greater than the available positive output current. Thus negative charge, rather than positive charge, is employed in forming the latent electrostatic image. In contrast to prior art charge image generators, the geometry of this invention results in the spaces between modulator electrodes being now remote from the generator electrodes. Sealing of this region with a solid dielectric is thus not required to prevent unwanted electrical discharge. This geometry greatly simplifies fabrication methods of the instant invention.

Figure 6:
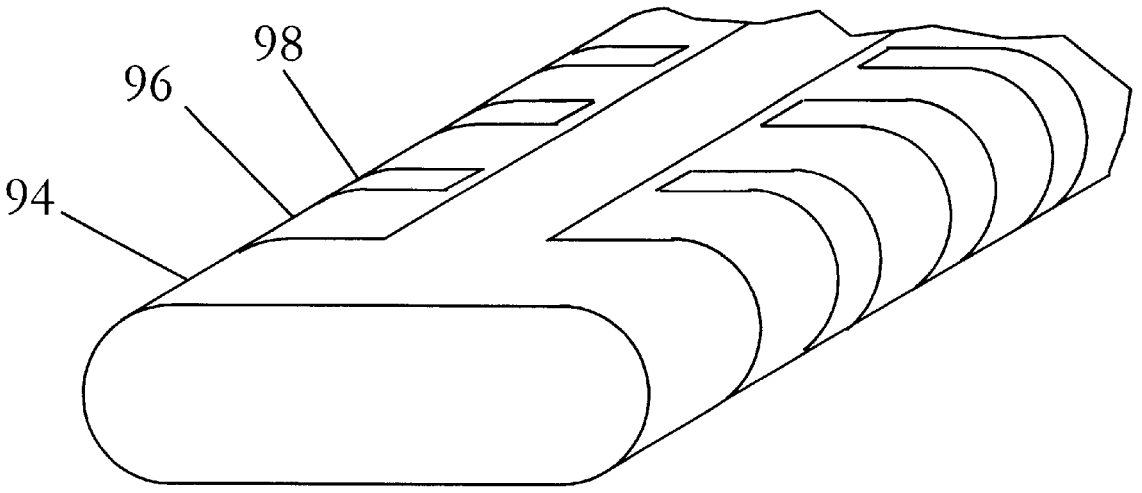
FIG. 6 is a schematic isometric view showing a method of mounting the charge image generator of the present invention.

FIG. 6 schematically illustrates a method of mounting the active elements of the charge image generator. Metal mounting block 94 supports the active elements mechanically with precise registration in the printer. The block also functions as a heat sink to distribute the heat generated in the active discharge. Insulating substrate 96, carrying electrode contacts 98, is adhesive bonded to mounting block 94. The mounting block provides the printer operator with a simple means to remove and replace defective or end-of-life charge image generator units.

Although the electrode contact regions are here shown in locations on the side of the mounting block opposite the active region of the charge image generator, these contact regions may alternately be located at the sides of the mounting block The mounting block is preferably fabricated of an aluminum extrusion. The extrusion is machined to form a flat mounting surface for the active region of the charge image generator. Precision holes may be formed at each end of the block to provide pin registration of the assembly when mounted in a printer. The block may be hard-coat anodized to an oxide thickness of about ten microns in order to provide a good bonding surface for the assembly adhesive. The anodic layer also provides some surface mechanical protection from scratches and incidental damage. Thick anodic oxide layers are to be avoided as the oxide, which is a thermal insulator, increases the thermal resistance between the block and the active charge generation regions of the assembly. The block may be provided with heat dissipating fins to improve heat transfer from the block. Alternately, the block may be provided with one or more through channels for air or liquid cooling.

Figure 5:
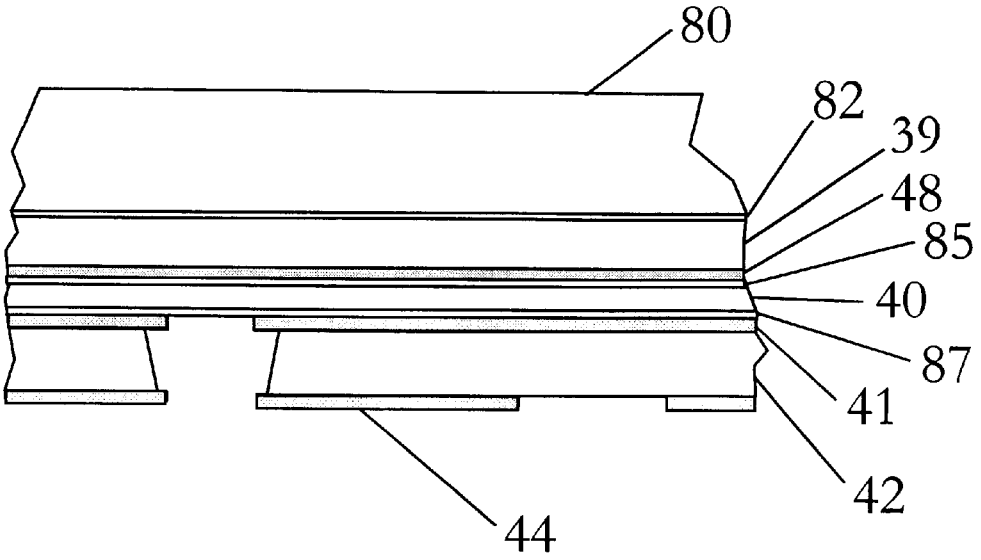
FIG. 5 is a detailed sectional schematic view of a charge image generator in accordance with the present invention.

FIG. 5 is an expanded view of the charge image generator shown in FIG. 2. This view shows adhesive bonding layers 82, 85, and 87.

A preferred method of fabricating charge image generators configured to the teachings of this invention employs two etched circuit elements. One of these elements consists of a two-sided etched assembly and the second is a single-sided etched assembly. Either or both of these assemblies may be fabricated using a rigid dielectric substrate or a flexible substrate; the latter providing better flexibility in charge image generator design.

The first of these etched flexible circuits consists of solid insulating substrate 39 having generator electrodes 48 on one surface This circuit may be fabricated using DuPont Pyralux$^R$ polyimide film having a thickness of 51 microns laminated on one side with ½ oz. (17 micron) copper. In order to provide maximum. heat transfer from the active discharge regions to the metal heat sink block, 80 the flexible circuit substrate should have a thickness not greater than 100 microns. Films of 25 to 50 micron thickness are preferred for high operating speed applications. The copper is etched to form the generator electrode. An example of an etched pattern may be seen in FIG. 4 where generator electrodes are shown as elements 75-1 through 75-4. Modulating electrodes are shown as elements 70-1 through 70-6. An aperture, 79, is shown in one modulator electrode. In practice, the number of generator lines may range from two to about twenty-one depending upon the application. Insulator 78 electrically isolates the discharge and modulator electrodes. This insulator has apertures aligned with apertures in the generator and modulator electrodes. Dielectric layer 73 isolates the generator electrodes from the discharge electrode.

The spaces between the generator lines must be filled with a solid dielectric to prevent discharge between adjacent generator lines and also to prevent air gap discharge caused by the fringing fields adjacent the generator electrodes. This filler dielectric may be coated onto the etched copper surface of the flexible circuit and then metered off with a straight edge. Alternately, if sufficient adhesive is employed in adhesive layer 85, this adhesive material may flow into the regions separating the generator electrodes thus electrically sealing these areas. A filler adhesive may also be sprayed onto the generator electrode side of the thin film. A final approach to sealing the regions between the generator electrodes involves hot pressing the etched assembly to imbed the electrodes even with the surface of the flexible dielectric.

Figure 4:
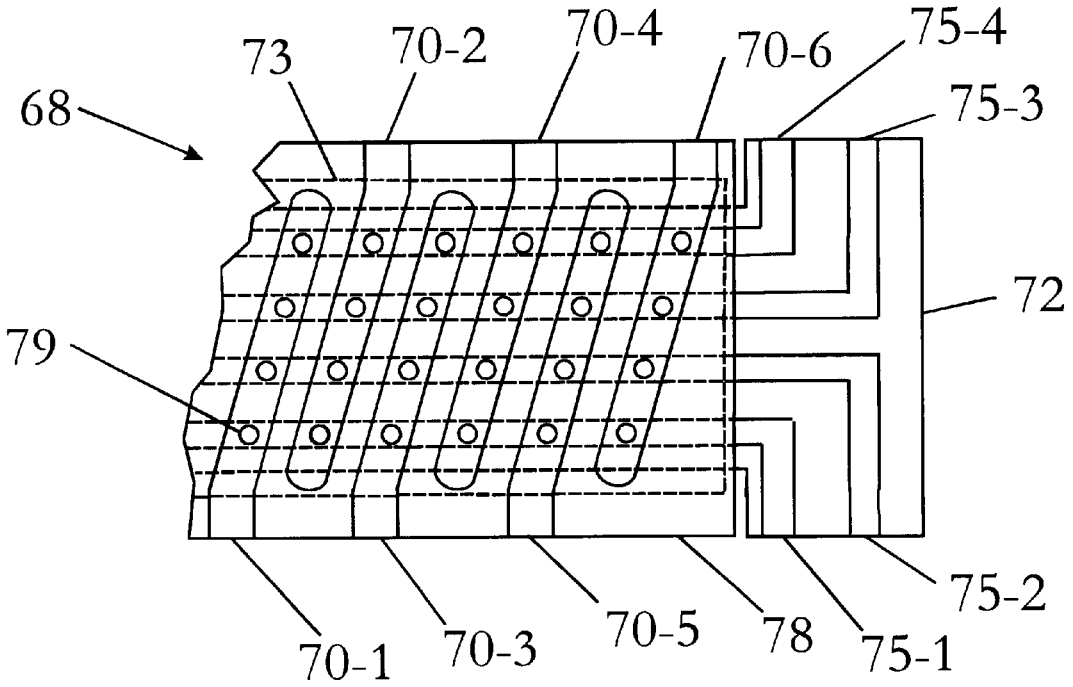
FIG. 4 is a view showing the layout of electrodes in accordance with the present invention.

Generator electrode substrate 72 may be formed into the shape of an "H" as seen in FIG. 4.

The second flexible circuit consists of discharge electrode 41, an insulating spacer layer 42 and modulation electrodes 44. This flexible circuit may be fabricated of DuPont Pyralux$^R$ polyimide film having metal foils bonded to both sides. It should be understood that many other thin plastic materials such as epoxy-glass, polyester, polycarbonate, and the like may also be employed in this application.

The air-gap electrical discharge creates a highly oxidizing environment. Copper, which is easily oxidized, is thus not suitable in this application unless the etched copper pattern is plated with a corrosion resistant metal such as cadmium, chromium, or palladium. Gold is to be avoided as a plating material since gold sputters in the high electrical field under ion bombardment. A chromate chemical conversion coating improves the oxidation resistance of the copper foil. Stainless steel foil, in the thickness range of about 10 to about 25 microns may be employed although this material eventually is oxidized. Preferable materials for the foil electrodes include members of the refractory metal family such as molybdenum, tantalum, or tungsten. While more difficult to etch, such metals resist corrosion for long periods of time.

Circular generator apertures are photoetched into the first side metal foil while modulator electrodes having circular apertures are photo-etched into the metal foil bonded on the second side of the flexible dielectric. The generator and modulator apertures must be registered in exact alignment with each other. This alignment is greatly simplified since the phototools (artwork) for both electrodes may be optically aligned once and hinged together so that the photo-imaging is carried out simultaneously for both electrodes.

Apertures must now be formed in the polyimide flexible circuit material in regions corresponding to the apertures in the electrodes. The discharge electrode very conveniently serves as a mask to permit the etching of the polyimide. Alternately, the modulator electrode apertures may be employed as the etching mask if the exposed flexible surface areas between modulator electrodes are masked. This latter method is preferred since it results in the removal of dielectric close to the edge of the apertures in the discharge electrode. Three methods are available to form the holes in the flexible circuit dielectric. Laser ablation, using either a $CO_2$, a Nd-Yag, or excimer laser are simple, direct, and clean methods of etching these apertures. Alternately, plasma etching may be employed, although this is a rather slow and expensive technique for films of this thickness. Finally, chemical etching may be employed—again using the etched foil as a resist.

In general, it is desirable to have the modulator electrode aperture diameters slightly larger than the discharge aperture diameters. The discharge aperture diameters should be slightly less that the width of the generator electrodes. This permits the ready alignment of the two flexible circuits and also eliminates any accidental variations in generator line—discharge aperture overlap. The thickness of the spacer layer should be about equal to the modulator electrode aperture diameter.

The electrode and dielectric dimensions depend upon application requirements such as output current and quality level as well as fabrication equipment capabilities. A typical high speed application might employ discharge electrode aperture diameters of about 100 microns, modulator electrode diameters of about 120 microns, spacer layer thickness of about 120 microns, generator line width of about 140 microns, and spacing between generator lines of about 150 microns.

The next major assembly operation involves laminating the flexible printed circuit containing the discharge and modulator electrodes to the flexible circuit containing the generator electrodes with dielectric 86 sandwiched between these two flexible circuits. Care must be exercised to align the discharge apertures with the generator line electrodes. Since the generator electrodes are in the form of stripes, accurate alignment is only required in the direction orthogonal to the direction of the generator stripe pattern. Pin registration may be employed. Alternately, since the dielectric is typically optically transparent, the alignment may be carried out visually.

Adhesive bonding layers 85 and 87 are employed in forming the lamination. These adhesive layers should preferably have high operating temperature capabilities as well as some elastomeric properties in order to provide dimensional latitude as differential thermal expansion occurs during high-speed operation. Silicone or fluorosilicone adhesives are preferred in this application. Dow Corning$^R$ 730 moisture cured fluorosilicone sealant is effective in this application. Thickness of adhesive layers 85 and 87 are somewhat critical and should be maintained between about two and about ten microns. Thicker layers reduce the electric field strength in the discharge region while thinner layers reduce the laminate peel strength.

Dielectric 86 must satisfy a number of critical criteria. The dielectric must be capable of operating continuously with a high voltage, high frequency voltage applied between its surfaces. Typical operating fields are in the range of about 60 to 100 volts per micron peak. Operating frequencies are in the range of about one to about ten megahertz. In order to prevent excessive dielectric heating, the dissipation factor of the dielectric at the operating frequency should be 0.02 or lower. For operation at reasonable ac applied potentials, in the range of 750 to 1500 volts peak, the dielectric thickness should not exceed about 35 microns. The relative dielectric constant of the dielectric should be about four or higher in order to minimize the electrical thickness of the dielectric. Finally, and most important, the dielectric must be able to withstand operating at elevated temperatures in the highly oxidizing environment created by the air gap electrical discharge. Discharge products include nitric acid vapor and active oxygen.

Inorganic materials capable of being formed in thin films may be used in the charge image generator. Muscovite mica, cleaved to a thickness of between 12 and 20 microns is used in prior art charge image generators. High dielectric constant pigment loaded silicone resins, described by McCallum et al in U.S. Pat. No. 4,958,172 (Sep. 18, 1990), have been employed in prior art charge image generators.

Fluorosilicone resins have improved oxidation resistance relative to silicones and may be utilized in this application. Charge image generators fabricated using a fluorosilicone resin as dielectric 86 may dispense with adhesive layers 85 and 87 if the lamination is formed before the fluorosilicone has been cured. In this case, the fluorosilicone serves as both dielectric and as adhesive. When employed as dielectric 86, it is preferable that the fluorosilicone be filled with a high dielectric constant filler such as titanium dioxide.

Glass may also be used as the dielectric. Schott America Glass & Scientific Products, Inc. supplies a drawn borosilicate glass in thickness as low as 30 microns. Corning also manufactures thin drawn glass, code 0211, suitable for this application. Both glasses have dielectric constants of 6.7 and withstand high operating voltage After the lamination of the two flexible circuit assemblies has been completed, the newly formed assembly is then adhesive bonded to the mounting block 80. Mounting adhesive layer 82 should be less than bout 25 microns in thickness in order to minimize thermal resistance between the discharge regions and the mounting block. This adhesive is preferrably flexible when cured in order to provide tolerance for thermal expansion strains. Either silicone or fluorosilicones adhesives are preferred.

An alternate final assembly procedure involves first bonding the generator flexible circuit to the mounting block. Next, dielectric 86 is placed over the mounted generator electrodes and then the discharge/modulator flexible circuit is carefully aligned with the generator electrodes and bonded to dielectric 86. Adhesive layers 85 and 87 may be coated on the surface of the generator and discharge electrodes prior to assembly. Alternately, the dielectric may be coated with these adhesive layers prior to assembly.

If adhesive layer 87 is not resistant to the oxidizing atmosphere of the electrical discharge, then this adhesive is removed from the surface of dielectric 86 in the area defined by the apertures in discharge electrode 88.

A complete charge image generator might consist of twelve generator lines and 576 modulator electrodes that together would produce 6912 crossover locations in the multiplexed matrix. At a resolution of 24 dots per millimeter, the image width would then be equal to 288 millimeters. The modulator electrodes would be driven using nine high voltage IC's such as manufactured by Supertex, Inc. These IC's each have shift registers and up to 64 output high voltage switches contained in one package.

Twelve gated oscillators would provide the generator electrode excitation. These oscillators might operate at a frequency of four megaHertz and provide bursts of about six cycles at a peak output voltage of about 1400 volts. The modulator drivers would provide a switching voltage pulse of amplitude 200 volts and duration of about one microsecond.

During operation, the charge image generator 38 is accurately positioned so that the modulator electrodes are spaced about 0.6 millimeters from the surface of dielectric receptor 55. The bias potential supplied by voltage source 52 is about 2500 volts with the discharge electrode being maintained negative with respect to charge receptor electrode 56. Supplies 51 and 52 represent the modulator driver IC and modulator bias. Supply 51, representing the printing "on" condition supplies about 50 volts with the discharge electrode being negative with respect to the modulator electrode. In the no print condition, supply 50 biases the discharge electrode about negative 150 volts with respect to the modulator electrode.

It requires only about 15 microseconds to scan every matrix aperture under the above conditions. Each scan generates the equivalent of one resolution line on the latent image receptor. At a print resolution of about 24 scan lines per millimeter, the print speed is about 2.8 meters per second.

Although the invention has been described herein with reference to specific embodiments, many modifications and variations therein will readily occur to those skilled in the art. Accordingly, all such variations and modifications are included within the intended scope of the invention.

What is claimed is:

1. Charge image generator for depositing an electrostatic latent image on an image receiving member said charge image generator comprising;

a first solid dielectric member having first and second sides;

a plurality of generator electrodes substantially in contact with a first side of said first solid dielectric member;

a continuous discharge electrode having a plurality of apertures substantially in contact with the second side of the first solid dielectric member, said apertures opposing said generator electrodes and defining discharge regions;

a second solid dielectric member having a first side substantially in contact with said generator electrodes, said second dielectric member having apertures aligned with apertures in said discharge electrode;

an array of modulator electrodes substantially in contact with the second side of said second solid dielectric member, said modulator electrodes having apertures aligned with apertures in said second solid dielectric member; and a high voltage time varying potential placed between said generator electrodes and said discharge electrodes to generate charged particles in said discharge regions.

2. Apparatus as defined in claim 1 wherein the first solid dielectric member comprises an inorganic glass.

3. Apparatus as defined in claim 1 wherein the first solid dielectric member comprises a mica sheet.

4. Apparatus as defined in claim 1 wherein the first solid dielectric member comprises a silicone film.

5. Apparatus as defined in claim 1 wherein the first solid dielectric member comprises a fluorosilicone film.

6. Apparatus as defined in claim 1 wherein the generator and modulator electrodes are comprised of molybdenum.

7. Apparatus as defined in claim 1 wherein the generator and modulator electrodes are comprised of tungsten.

8. A method of fabricating a charge image generator for depositing an electrostatic latent image on an image receiving member comprising the steps of:

providing a charge image generator mounting block;

providing a first etched circuit member carrying on one of its sides a plurality of generator electrodes;

providing an oxidation resistant solid dielectric sheet;

providing a second etched circuit member carrying on its first side a continuous apertured discharge electrode and on its second side an array of apertured modulator electrodes;

forming apertures in said second etched circuit member, said apertures corresponding to apertures locations in said discharge and said modulator electrodes;

laminating the non-electroded side of said first etched circuit member to said mounting block;

laminating the first side of the oxidation resistant solid dielectric sheet to the generator electroded side of said first etched circuit mamber;

laminating the first side of said second etched circuit member to said oxidation resistant solid dielectric sheet so that apertures in said second etched circuit member align with said generator electrodes of said first etched circuit member.

9. A method as defined in claim 8 in which said etched circuit members are are fabricated using a flexible dielectric substrate.

10. A method as defined in claim 8 in which said insulation resistant solid dielectric sheet is fabricated from mica.

11. A method as defined in claim 8 in which said insulation resistant solid dielectric sheet is fabricated from an inorganic glass.

12. A method as defined in claim 8 in which said insulation resistant solid dielectric sheet is fabricated from the group consisting of silicones and fluorosilicones.

13. A method as defined in claim 8 in which said discharge and modulator electrodes are selected from the group consisting of the refractory metals molybdenum, tungsten, and tantalum.

14. A method as defined in claim 8 in which said discharge and modulator electrodes consist of copper plated with a corrosion resistant metal film.

15. A method as defined in claim 8 in which said discharge and modulator electrodes consist of stainless steel.

* * * * *